US006202636B1

(12) United States Patent
O'Brien

(10) Patent No.: US 6,202,636 B1
(45) Date of Patent: Mar. 20, 2001

(54) PITCHING MACHINE

(75) Inventor: Norman James O'Brien, Coppell, TX (US)

(73) Assignee: The Lobit Partnership, Farmers Branch, TX (US)

( * ) Notice: Subject to any disclaimer, the term of this patent is extended or adjusted under 35 U.S.C. 154(b) by 0 days.

(21) Appl. No.: 09/225,520

(22) Filed: Jan. 6, 1999

(51) Int. Cl.[7] ..... F41B 11/00
(52) U.S. Cl. ..... 124/71; 124/73
(58) Field of Search ..... 124/71, 72, 73, 124/74, 75, 81; 42/78

(56) References Cited

U.S. PATENT DOCUMENTS

| | | | | |
|---|---|---|---|---|
| 434,662 | * | 8/1890 | Gatling . | |
| 1,245,093 | * | 10/1917 | Doubleday . | |
| 2,526,018 | * | 10/1950 | Foster et al. . | |
| 3,228,127 | * | 1/1966 | Bullock . | |
| 3,680,540 | * | 8/1972 | Stengl . | |
| 3,930,486 | * | 1/1976 | Kahelin . | |
| 4,094,294 | * | 6/1978 | Speer . | |
| 4,774,928 | * | 10/1988 | Kholin . | |
| 4,951,644 | * | 8/1990 | Bon . | |
| 5,507,271 | * | 4/1996 | Acton . | |
| 5,660,160 | * | 8/1997 | Prescott, Jr. . | |
| 5,771,621 | * | 6/1998 | Rogers | 42/55 |

FOREIGN PATENT DOCUMENTS

| | | | | |
|---|---|---|---|---|
| 815309 | * | 6/1969 | (CA) | 124/71 |
| 2228067 | * | 8/1990 | (GB) | 124/73 |
| WO 8602011 | * | 2/1986 | (SU) | 124/73 |

* cited by examiner

*Primary Examiner*—Michael J. Carone
*Assistant Examiner*—Son T. Nguyen
(74) *Attorney, Agent, or Firm*—Locke Liddell & Sapp LLP

(57) ABSTRACT

The present invention is a pitching machine for use in batting and fielding practice for baseball and softball. The pitching machine of the present invention uses an expanding gas to propel a ball down a barrel toward the intended target. While the expanding gas could be created by a variety of means without departing from the scope of the present invention, including a piston, ignition of a combustible fuel, or a chemical reaction, the preferred embodiment of the present invention uses compressed air in a reservoir. The compressed air is held in a reservoir and released into the barrel behind the ball using a quick release valve. Spin is imparted on the ball by means of an engageable friction surface which forms a portion of the barrel, thereby allowing the pitching machine of the present invention to simulate any type of pitch. The barrel is able to rotate relative to the pitching machine to allow the engageable friction surface to contact the ball at any angle.

9 Claims, 10 Drawing Sheets

12
110
34
108
22
96
100
64
112
60
114
68
98
66
99
10
158
113
156
97

PITCHING MACHINE

This invention relates to pitching machines for simulating batting and fielding practice. Particularly, pitching machines that are capable of simulating all types of pitched balls.

BACKGROUND OF THE INVENTION

Virtually every baseball and softball player relies on hitting practice with pitching provided by persons of varied ability or by one of various types of pitching machines. Although some are fortunate to have the pitching of an experienced, capable person, by and large consistent and competitive pitching can only be obtained at the professional level or by the use of pitching machines.

There have been primarily two types of pitching machines developed to pitch baseballs and softballs. First is the catapult type pitching machine. This machine uses an arm that violently rotates about one end to fling a ball at the target just like a catapult. While effective for simulating fastball type pitches these machines cannot impart the spin on the ball to simulate breaking pitches. Also, these machines tend to be bulky which prevents them from being portable, and forces them to be used at a fixed location.

The other type of commonly used pitching machine is the flywheel type pitching machine. These machines use one, two, or three spimning flywheels to propel the ball toward the batter. By pinning one flywheel at a greater speed than the other, spin can be imparted on the ball causing it to 'break'. This allows the machine to simulate curveballs, sliders, or other breaking pitches. Flywheel type machines are also fairly portable allowing them to be set up wherever required. The flywheel pitching machines do have drawbacks, however. The flywheels themselves lose momentum when 'pitching' a ball and can take some time to recover the lost energy. Further, the flywheels themselves must be repositioned to simulate different types of breaking pitches and different handed pitchers. This takes time requiring a trial and error process for aiming, and also tells the batter what type of pitch to expect before the ball is actually pitched.

What is needed is a pitching machine that can pitch at a high velocity, yet still impart enough spin to the ball to simulate breaking pitches. Additionally, the pitching machine should not give visual clues to the batter as to which type of pitch to expect and should not take an inordinate amount of time to prepare for the next pitch.

SUMMARY OF THE INVENTION

The present invention is a pitching machine that uses expanding gas, from any of a variety of sources to propel a baseball, or other ball, through a barrel toward the target. The barrel of the pitching machine includes a friction plate, which is used to impart spin to the baseball. The friction plate has multiple settings to allow different amounts of spin to be imparted, and the barrel can be rotated allowing the friction plate to contact any portion of the ball allowing any type of spin to be imparted. The present invention can also include an automatic loader to load balls into the machine for firing without any human intervention.

The features and advantages of the invention will become more readily understood from the following detailed description taken in conjunction with the appended claims and attached drawing wherein:

DESCRIPTION OF THE PREFERRED EMBODIMENTS

Figure 1:
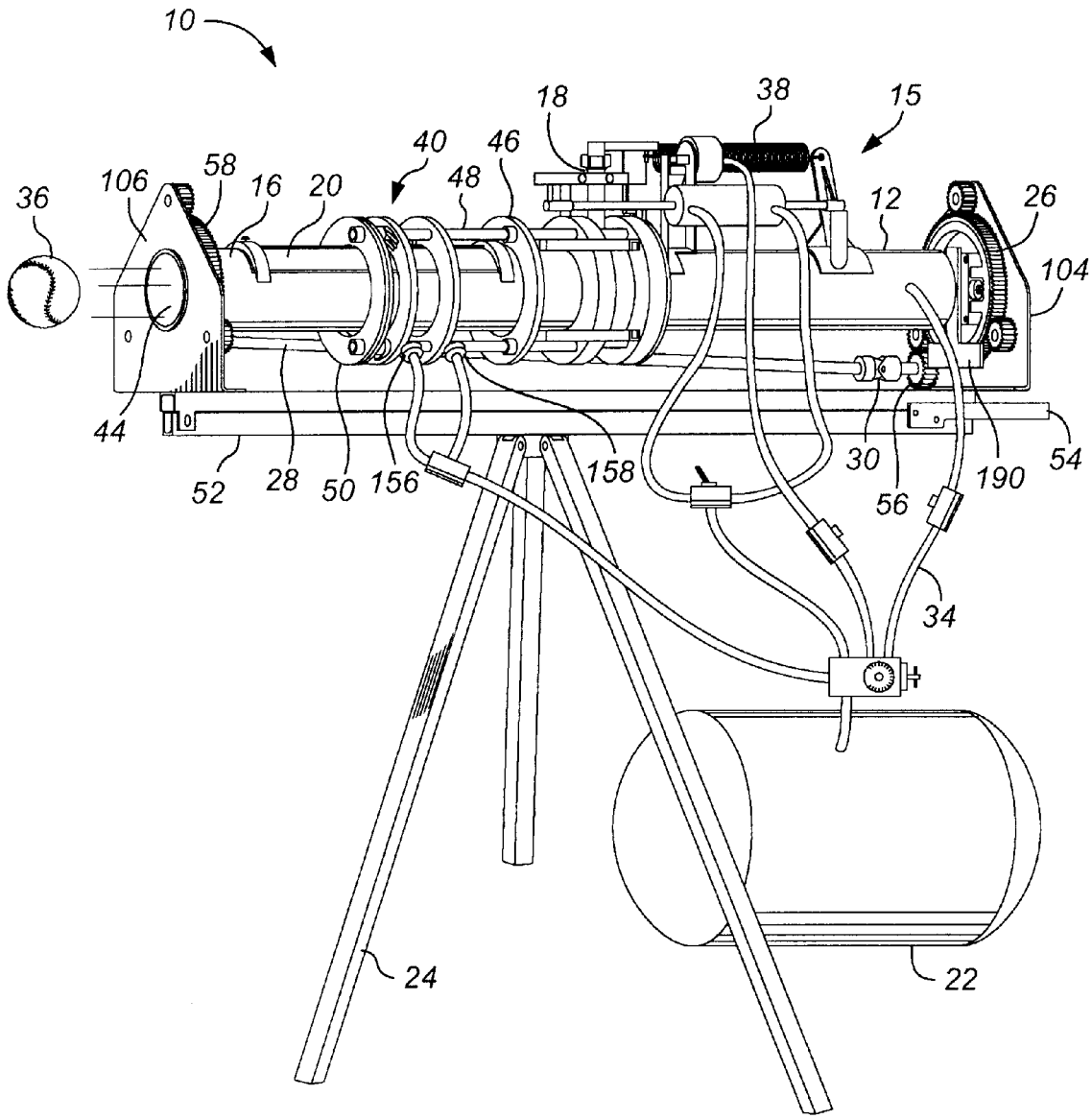
FIG. 1 is a perspective view of the preferred embodiment of a pneumatic pitching machine encompassing the present invention.

FIG. 1 shows pitching machine 10 which is the preferred embodiment of the present invention. Pitching machine 10 uses expanding gas from a propulsion mechanism 15 to propel a ball toward the intended target. In the preferred embodiment, propulsion mechanism 15 is formed by reservoir 12 and quick release valve 18. Compressed air from compressed air source 22 is delivered to reservoir 12 through reservoir hose 34. The compressed air is held in reservoir 12 by quick release valve 18. Ball 36 is placed in barrel 16 adjacent to quick release valve 18. When pitching machine 10 is ready, quick release valve 18 is opened allowing the compressed air in reservoir 12 to accelerate ball 36 down barrel 16 and out of pitching machine 10 toward the target. Spring 38 is used to open quick release valve 18 as instantaneously as possible so that the expansion of the compressed air into barrel 16 occurs quickly enough to accelerate ball 36.

While the preferred embodiment of the present invention is a pneumatic device using compressed air to propel the ball, the present invention contemplates any type of propulsion mechanism that uses expanding gases to accelerate ball 36 down barrel 16. For example, instead of propulsion mechanism 15 being formed by reservoir 12 and quick release valve 18, propulsion mechanism 15 could be a combustion chamber adjacent to barrel 16 which ignites a combustible material to provide the expanding gas to accelerate ball 36 down barrel 16. Similarly, propulsion mechanism 15 could be formed by a piston arrangement in which a piston quickly compresses the air in a chamber behind the ball, where the compressed air is allowed to expand behind the ball and accelerate it down barrel 16. As can be seen, the present invention would include any type of propulsion mechanism that provides for an expanding gas to propel ball 36.

To simulate the real pitches thrown by real pitchers it is necessary to spin ball 36 in order to make ball 36 curve or 'break'. The amount of spin and the direction of the spin determine the 'break' and, therefore, type of pitch. For example, a fastball will have relatively low rate of backspin while a true curve ball will have a high rate of topspin. Sliders and screwballs have high rates of sidespin, and knuckle balls ideally have no spin at all. Pitching machine 10 is able to simulate every type of pitch thrown by pitchers. Spin is imparted on ball 36 as it travels down the barrel by adjustable friction plate 20. Adjustable friction plate 20 has three general settings which are controlled by front and rear friction plate activation pistons 156 and 158: completely disengaged, partially engaged and completely engaged. The amount of engagement of the front and rear portions of adjustable friction plate 20 can also be controlled and varied.

When completely disengaged the interior surface of adjustable friction plate 20 is even with the interior surface of barrel 16. Partially engaging adjustable friction plate 20 causes the inner surface of the end of adjustable friction plate 20 closest to barrel end 44 to be moved into the interior of barrel 16 where it is able to contact the ball as it travels down barrel 16. Fully engaging adjustable friction plate 20 causes the entire inner surface of adjustable friction plate 20 to be lowered into the interior of barrel 16. The movement of adjustable friction plate 20 is accomplished by friction plate control mechanism 40, which will be discussed with respect to FIG. 7.

Having adjustable friction plate 20 fully retracted allows pitching machine 10 to 'throw' a knuckleball with little or no spin on ball 36. Adjustable friction plate 20 is partially engaged to throw low-spin pitches such as a fast ball or slider, while Fully engaging adjustable friction plate 20 allows pitching machine 10 to throw high-spin pitches such as curveballs, rising fastballs, etc.

The direction of spin imparted by adjustable friction plate 20 is controlled by rotating barrel 16 relative to pitching machine 10 such that adjustable friction plate 20 contacts different areas of ball 36. Barrel 16 rotates inside front collar 50 and rear collar 46, which are held by collar rods 48. Barrel 16 is rotated by turning barrel rotating knob 102 shown in FIG. 2. Barrel rotating knob 102 rotates barrel drive gear 56, which turns linkage rod 28 by means of universal joint 30. Linkage rod 28 then turns barrel 16 by turning barrel end gear 58 through universal joint 32 shown in FIG. 2.

The aim of pitching machine 10 is adjusted to compensate for the spin of ball 36 by means of curve compensating mechanism 26. Curve compensating mechanism 26 adjusts the aim of pitching machine 10 opposite the direction of the spin of ball 36. For example, if pitching machine 10 is set to throw a left breaking pitch, then the curve compensating mechanism 26 will cause pitching machine 10 to aim slightly to the right of the original target. Curve compensating mechanism 26 will be discussed in greater detail with reference to FIG. 5.

Any number of means may Support pitching machine 10. FIG. 1 shows tripod 24, which is connected to frame 52. Tripod 24 may be collapsed to make pitching machine 10 portable. Frame 52 holds pitching machine 10 by rear end plate 104 and front end plate 106. Aiming handle 54 is connected to frame 52 and is used to move pitching machine 10 relative to tripod 24. Moving aiming handle 54 allows pitching machine 10 to be aimed at the target, and to be easily adjusted during use to throw high, low, inside or outside pitches.

Figure 2:
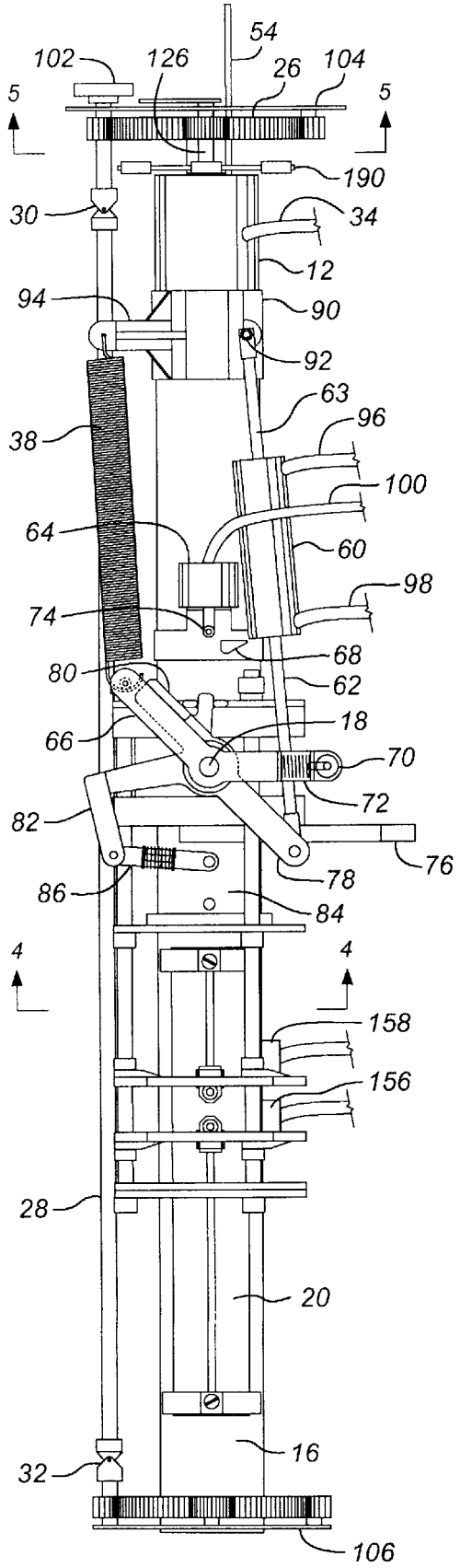
FIG. 2 is a top view of the pitching machine shown in FIG. 1

Referring now to FIG. 2, pitching machine 10 is shown in a top view. In order for pitching machine 10 to operate correctly, quick release valve 18 must be opened as instantaneously as possible. As this is necessarily a rather violent act, it cannot be accomplished manually. Instead, quick release valve 18 is cocked and fired using pneumatic pistons connected to the compressed air source by hoses 96, 98 and 100. Cocking piston 60 acts to close, or cock, quick release valve 18 into firing position, and to move loading sleeve 84 between its loading and firing positions. The position, open or closed, of quick release valve 18 is determined by valve arm 66. When valve release roller 70 on valve arm 66 is held by valve arm stop 68, quick release valve 18 is closed and holds the compressed air in reservoir 12. When quick release valve 18 is closed, spring 38 is stretched and ready to pull valve arm 66 to instantaneously open quick release valve 18.

Pitching machine 10 is fired by releasing valve arm 66 from valve arm stop 68 so that spring 38 can open quick release valve 18. This is accomplished by means of firing cylinder 64. Firing cylinder 64 is a pneumatic cylinder connected to compressed air source 22 from FIG. 1. Firing cylinder 64, when activated, extends valve release rod 74, which compressed valve release spring 72 on valve arm 66 such that valve release roller 70 is forced off valve arm stop 68. Once valve release roller 70 is off valve arm stop 68, spring 38 can contract to open quick release valve Cocking piston 60 is used to cock, or close, quick release valve 18. Cocking piston 60 is a two-way pneumatic piston, which can both push and pull, and is connected to compressed air source 22 from FIG. 1 by hoses 96 and 98. Cocking piston 60 is connected to cocking arm 78, and includes cocking arm catch 80. The operation of cocking piston 60 will be described in greater detail with reference to FIG. 6. Cocking arm 78 includes loading arm 82 which is connected to loading sleeve arm 86. The operation of the loading mechanism will also be discussed with respect to FIG. 6.

Anchor bracket 90 is connected around reservoir 12. Anchor bracket 90 serves as the fixed end both for spring 38 and for cocking piston 60 by means of cocking piston anchor rod 63. Cocking piston anchor rod 63 is connected to anchor bracket 90 via the hinged pin of cocking piston rod connector 92. Spring 38 is connected to spring anchor arm 94 of anchor bracket 90. Curve compensator 26 is mounted to the rear end plate 104 and connected to reservoir 12 by pivot rod 126 through stabilizer mechanism 190.

Figure 3:
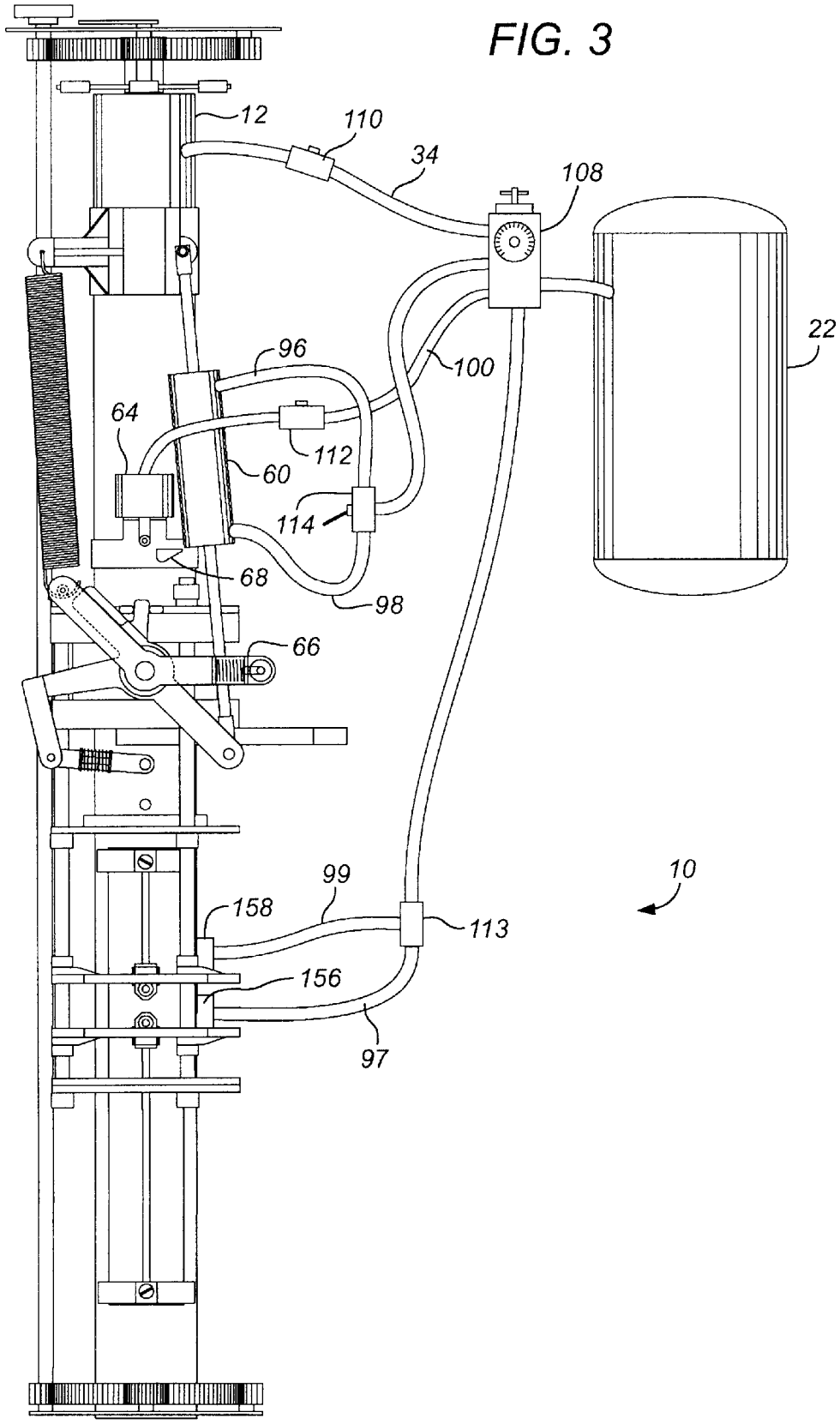
FIG. 3 is a top view of the pitching machine shown in FIG. 1 showing the pneumatic connections.

Referring now to FIG. 3, the operation of the pneumatic system of pitching machine 10 will be described. Compressed air is stored in compressed air source 22. Compressed air source 22 can be any means by which compressed air is supplied to pitching machine 10, including a compressed air tank, or an air compressor. Regulator 108 regulates the pressure of the compressed air supplied by compressed air source 22. Hose 34 supplies air to reservoir 12 through reservoir valve 110. The pressure of the compressed air in the reservoir determines the speed of the pitch thrown by pitching machine 10. Regulator 108 can be used to vary the pressure of the compressed air in reservoir 12, and therefore, to vary the speed of the pitches. Opening reservoir valve 110 allows reservoir 12 to be charged after each pitch is thrown.

Firing cylinder 64 is supplied with compressed air by hose 100 through firing cylinder valve 112. Firing cylinder valve 112 activates firing cylinder 64 which fires pitching machine 10. Opening firing cylinder valve 112 causes firing cylinder 64 to extend valve release rod 74, thereby releasing valve arm 66 from valve arm stop 68 as described with reference to FIGS. 2 and 6. Cocking piston 60 is supplied with compressed air through hoses 96 and 98 from cocking piston valve 114. Cocking piston valve is two-way valve as is required to operate two-way cocking piston 60. Cocking piston valve 114can either be open to supply hose 96, thereby operating cocking piston 60 in a push mode, or open to supply hose 98, thereby operating cocking piston 60 in a pull mode.

Front and rear friction plate activation pistons 156 and 158 are supplied by hoses 97 and 99, respectively. Valve 113 controls the supply of compressed air to the pistons and allows either or both of front friction plate activation piston 156 or rear friction plate activation piston 158 to be charged with compressed air. As will be discussed in greater detail with respect to FIG. 7, charging friction plate activation pistons 156 or 158 with air causes the associated portion of adjustable friction plate 20 to become engaged by lowering the inner surface of adjustable friction plate 10 into barrel 16. Removing the compressed air from the piston disengages the associated portion of adjustable friction plate 20.

Figure 4:
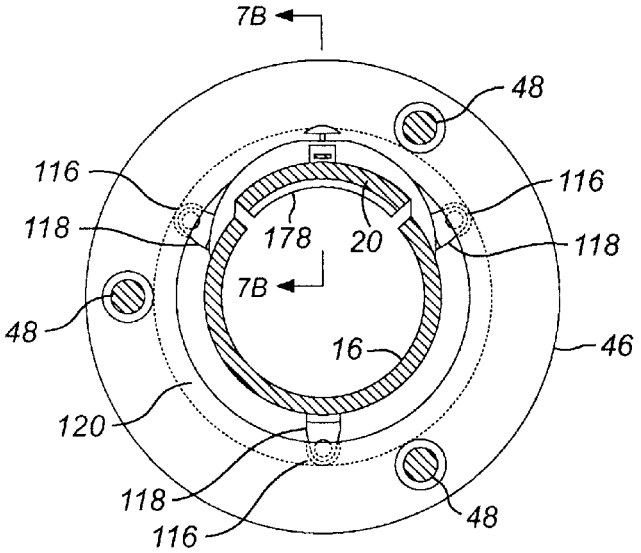
FIG. 4 is a cross-sectional view of the barrel and the adjustable friction surface of the pitching machine.

Referring now to FIG. 4 an interior cross-section of barrel 16 and adjustable friction plate 20 is shown. Barrel 16 rides within channel 120 of rear collar 46 and front collar 48 from FIG. 1. Rear and front collars 46 and 50, respectively, are connected and held fixed to reservoir 12 by collar rods 48. Rollers 116 are connected to barrel 16 by roller stays 118 and ride in channel 120 allowing barrel 16 to rotate freely. Adjustable friction plate 20 is shown in its disengaged state such that inner surface 178 forms a continuous cylinder with the interior surface of barrel 16. As will be discussed with reference to FIG. 7, inner surface 178 of adjustable friction surface 20 can be lowered into barrel 16 such that inner surface 178 comes in contact with the ball as it travels down barrel 16.

Figure 5:
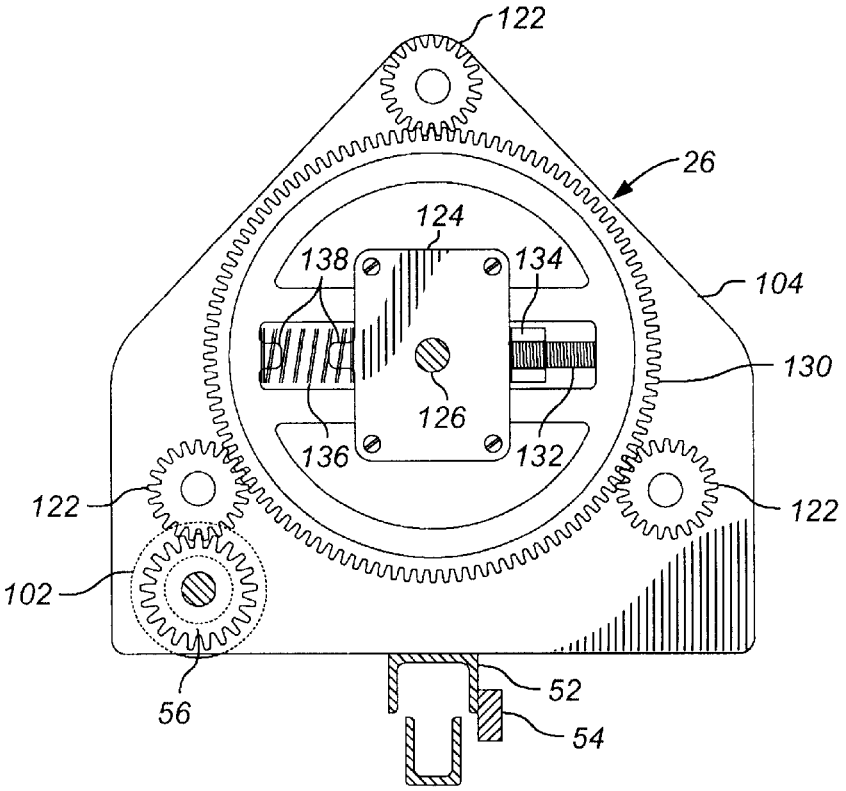
FIG. 5 is a view of the curve compensating mechanism of the pitching machine.

Referring now to FIG. 5, the curve compensating mechanism for pitching machine of the present invention is shown. As stated with respect to FIG. 1, the curve compensating mechanism 26 allows the aim of the machine to be adjusted to compensate for the expected curve of the ball. Curve compensating mechanism 26 is mounted on rear end plate 104, and is connected to the reservoir by traveler plate 124. Pivot rod 126 allows the elements of curve compensating mechanism 26 to rotate freely while stabilizer mechanism 190 maintains the reservoir in an upright position.

Curve compensating mechanism 26 includes main gear 130, which is held to rear end plate 104 by idler gears 122 while being allowed to rotate freely. Main gear 130 is turned in conjunction with barrel 16 by barrel rotating knob 102 by means of barrel drive gear 56. This keeps the action of curve compensating mechanism in sync with the curve supplied by adjustable friction plate 20 of FIG. 1. The aim of pitching machine 10 is adjusted by moving the traveler plate 124 and thus the aim of reservoir 12 and barrel 16 along curve compensator screw 132. Curve compensator knob 134 is threaded on curve compensator screw 132 and allows traveler plate 124 to be moved by turning curve compensator knob 134. Traveler plate 124 is held firmly on curve compensator screw 132 by curve compensator spring 136 mounted on curve compensator spring stays 138.

Figure 6A:
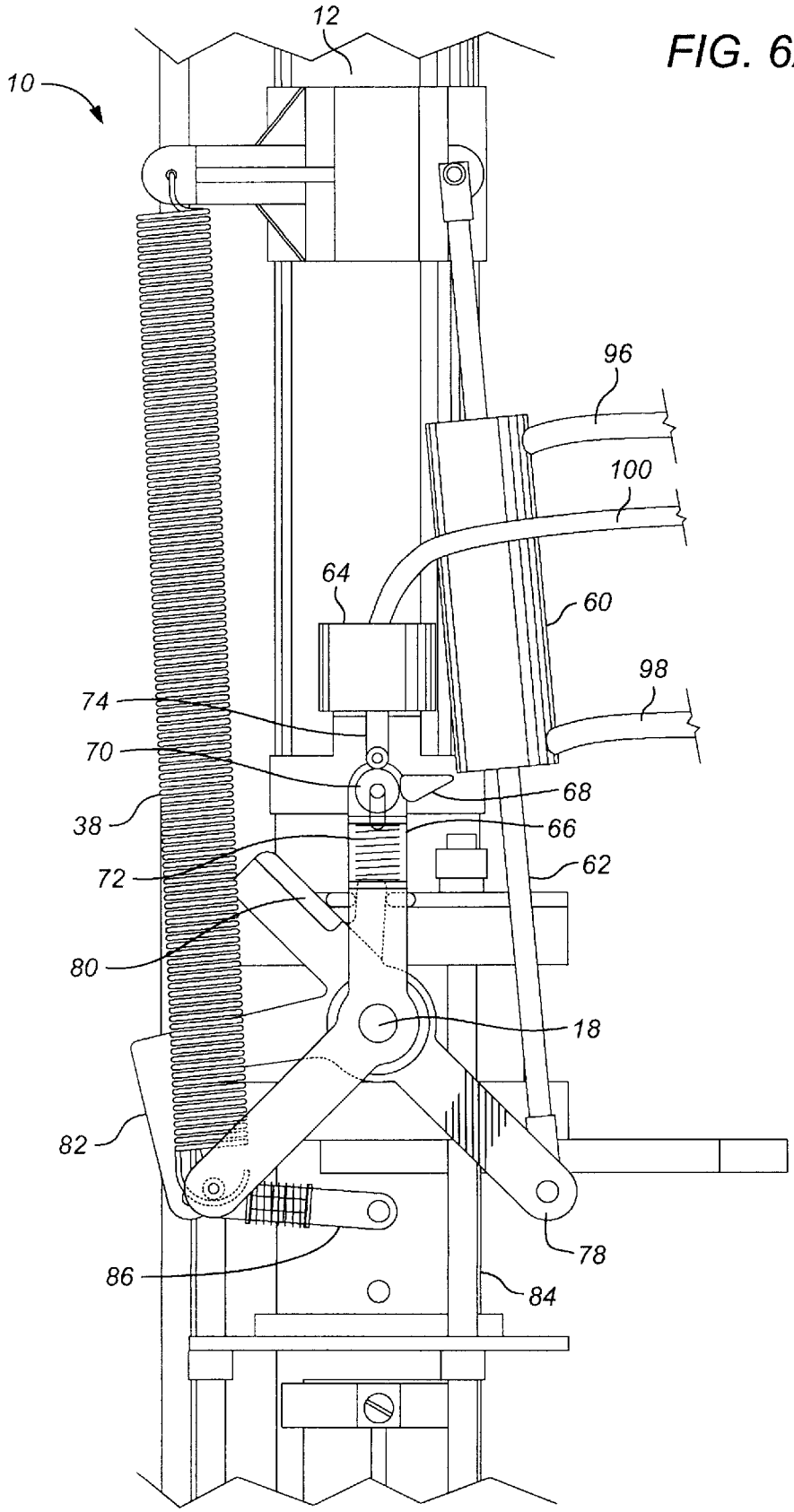
FIGS. 6A, B, and C are top views of the pitching machine showing the operation of the quick release valve.

Referring now to FIGS. 6A, B, and C, the operation of cocking piston 60 and firing cylinder 64 will be described. Cocking piston 60 and firing cylinder 64 operate to move the firing and loading mechanisms of pitching machine 10 between three states. These three states are ready state, post-pitch state, and loading state.

FIG. 6A shows the ready state in which pitching machine 10 is loaded with a ball, loading sleeve 84 is in line with barrel 16, and reservoir 12 is charged with compressed air. In this position, cocking piston 60 has cocking piston rod 62 fully extended. When cocking piston rod 62 is fully extended loading arm 82 and loading sleeve arm 86 are retracted and loading sleeve 84 is in pitching position. Further, cocking arm catch 80 has been disengaged from valve arm 66 which will allow valve arm 66 to swing freely when released from valve arm stop 68.

Pitching machine 10 is fired from the ready state of FIG. 6A by activating firing cylinder 64. When compressed air is applied to firing cylinder 64 by opening firing cylinder valve 112 of FIG. 3, thereby supplying compressed air through hose 100, firing cylinder 64 extends valve release rod 74. Extending valve release rod 64 compresses valve release spring 72 and disengages valve release roller 70 from valve arm stop 68. When valve release roller 70 is disengaged from valve arm stop 68, spring 38 acts on valve arm 66 causing quick release valve 18 to be opened instantaneously, thereby pitching the ball in barrel 16.

Figure 6B:
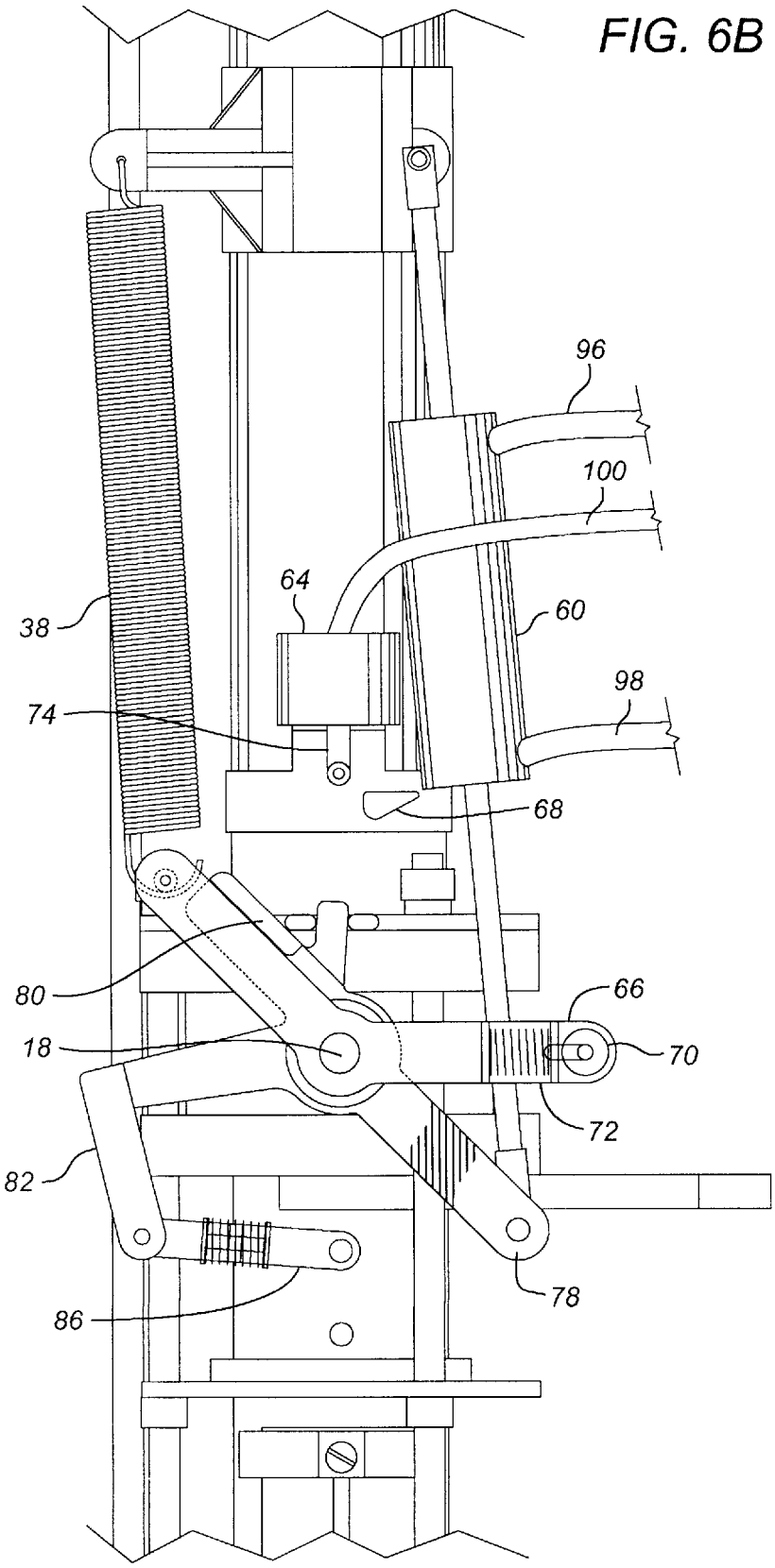

Referring now to FIG. 6B, the pitching machine is shown in the post-pitch state. In the post-pitch state, spring 38 is relaxed and valve arm 66 is against valve arm catch 80. Operating cocking piston 60 in its pull mode by charging hose 98 using cocking piston valve 114 causes cocking arm 78 to be pulled back bringing valve arm 66 with it by means of valve arm catch 80.

Figure 6C:
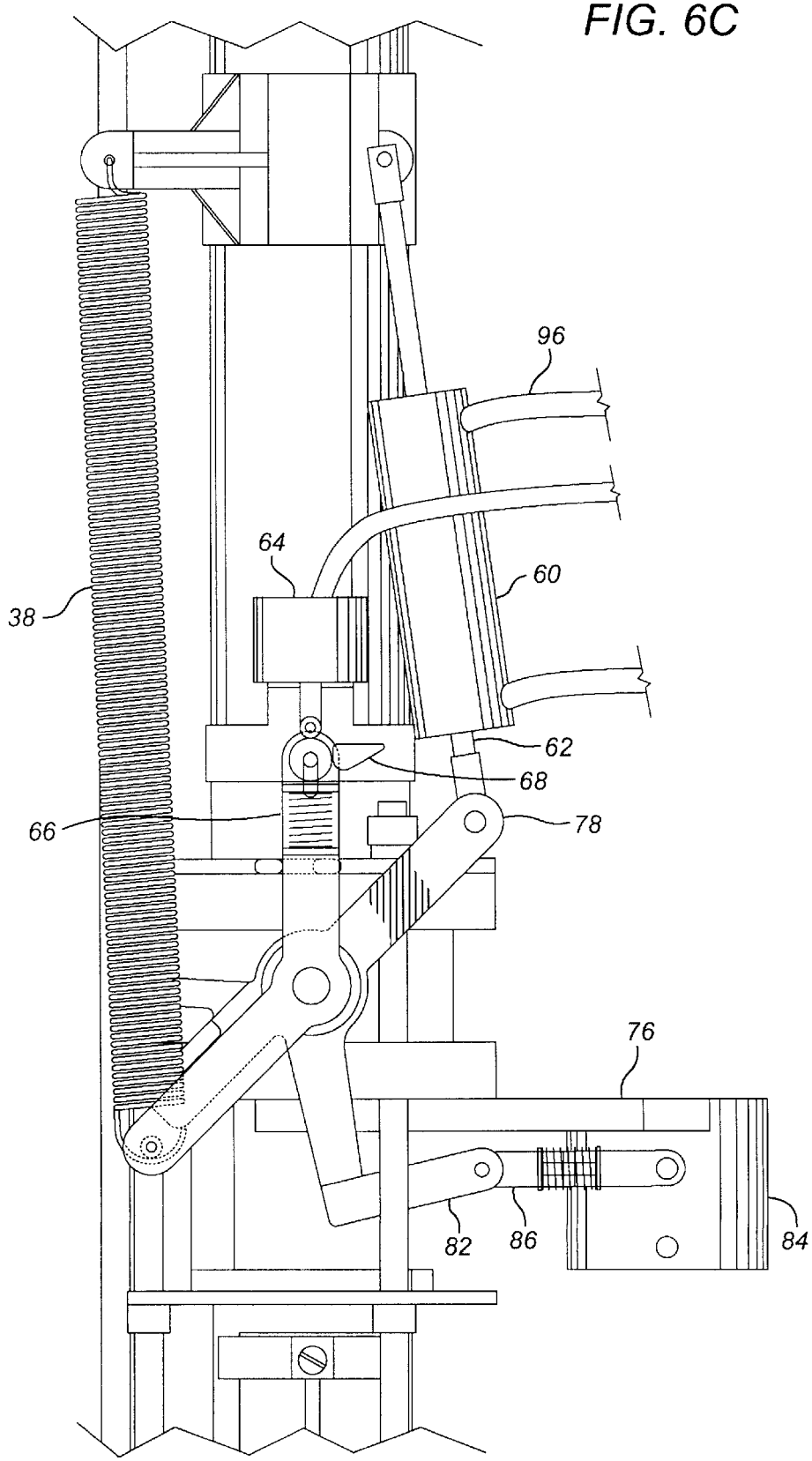

Referring now to FIG. 6C, cocking piston continues to pull back cocking arm 78 until valve arm 66 is reengaged with valve arm stop 68 and spring 38 is stretched into pitching position. Cocking piston 60 and cocking arm 78 in the completely retracted state also cause loading arm 82 and loading sleeve arm 86 to extend, disengaging loading sleeve 84 from barrel 16. Loading sleeve 84 is extended along guide 76 and is in position to receive a new ball.

Charging cocking piston 60 with compressed air from hose 96 extends cocking piston rod 62 and cocking arm 78. Extending cocking arm 78 retracts loading arm 82 and loading sleeve arm 86, returing loading sleeve 84 to the pitching position in line with the rest of barrel 16. Valve arm 66 is held in place by valve stop 68. With cocking piston rod 62 fully extended, pitching machine 10 is returned to the ready state shown in FIG. 6A.

Figure 7A:
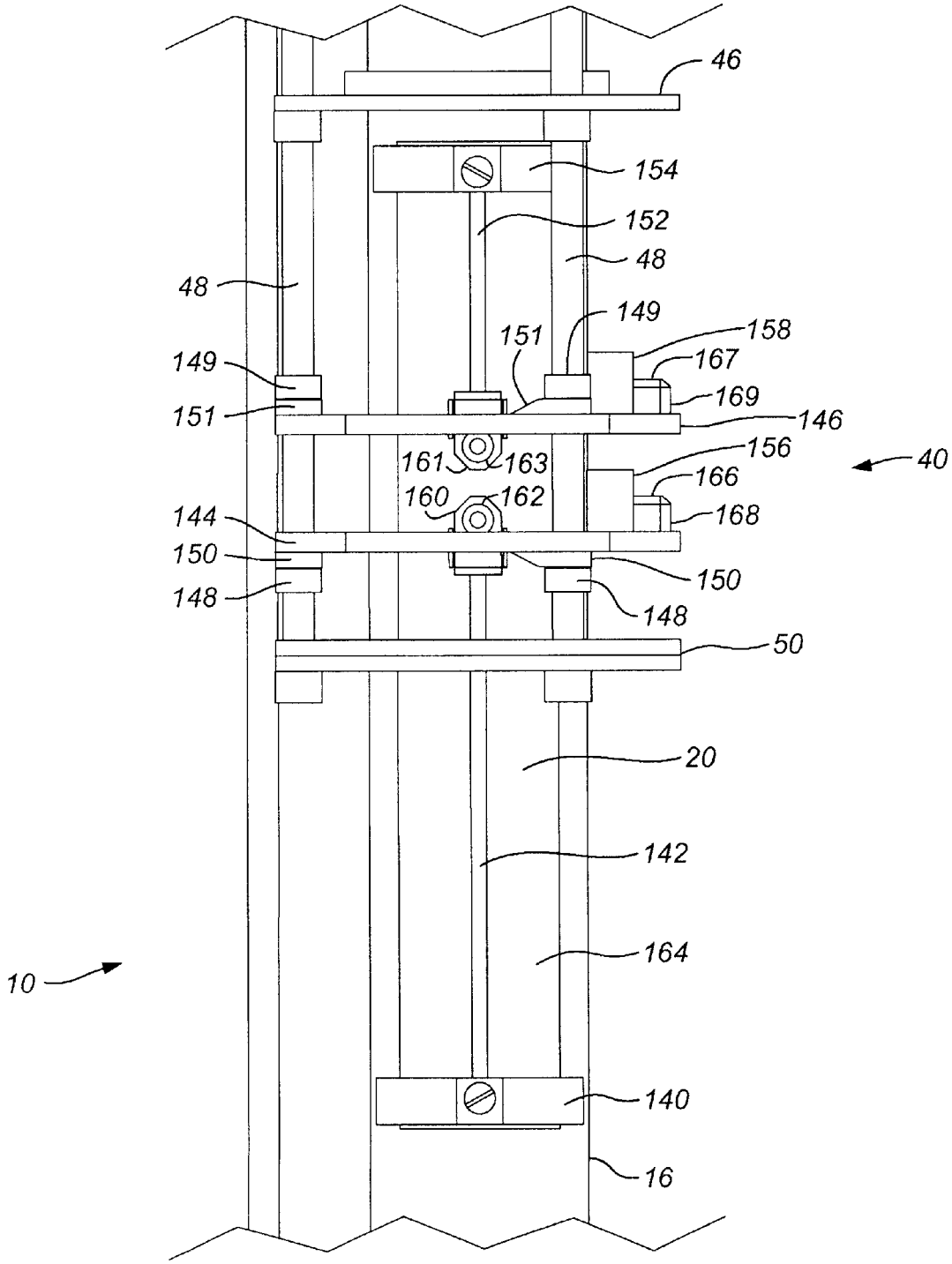
FIG. 7A is a top view of the pitching machine showing the friction plate control mechanism.

Referring now to FIGS. 7A, B and C, the operation of adjustable friction plate 20 will be described. As stated, pitching machine 10 uses adjustable friction plate 20 to impart spin on the ball as it is accelerated down the barrel. Pitching machine 10 uses friction plate control mechanism 40 to either partially engage, or fully engage adjustable friction plate 20. Friction plate control mechanism 40 is formed essentially by front and rear friction plate activation pistons 156 and 158, front and rear wedge plates 144 and 146, front and rear friction plate engagement rods 142 and 152, and front and rear friction plate engagement mechanisms 140 and 154.

Adjustable friction plate 20 is partially engaged by charging front friction plate activation piston 156 with compressed air, which extends friction plate piston rod 166 forcing front wedge plate 144 to rotate. When front wedge plate 144 rotates, wedges 150, fixed to front wedge plate 144 are forced up fixed wedge stops 148. This forces front wedge plate 144 to move back relative to pitching machine 10 the thickness of wedges 50. The movement of front wedge plate 144 acts, by means of front friction rod roller 162 and front roller mount 160, to drawn front friction plate engagement rod 142 back relative to pitching machine 10. Pulling front friction plate engagement rod 142 back engages front friction plate surface 164 of adjustable friction plate 20 by means of front friction plate engagement mechanism 140 which is attached to barrel 16. Front friction plate engagement mechanism 40 is shown in greater detail in FIG. 7C.

Fully engaging adjustable friction plate 20 involves activating both front friction plate engagement mechanism 140 and rear friction plate engagement mechanism 154 thereby engaging the entire inner surface of adjustable friction plate 20. The activation of rear friction plate engagement mechanism 154 is accomplished exactly as described above with respect to front friction plate engagement mechanism 140 using rear friction plate activation piston 158 to rotate rear wedge plate 146 by means of rear friction plate piston rod 167 and rear wedge plate linkage 169. As before, the rotation of rear wedge plate 146 forces wedges 151 up fixed wedge stops 149, thereby forcing rear wedge plate 146 to move forward relative to pitching machine 10. The movement of rear wedge plate 146 causes rear friction rod roller 163 and rear friction rod roller mount 161 to draw rear friction rod 152 forward, thereby activating rear friction plate engagement mechanism.

Figure 7B:
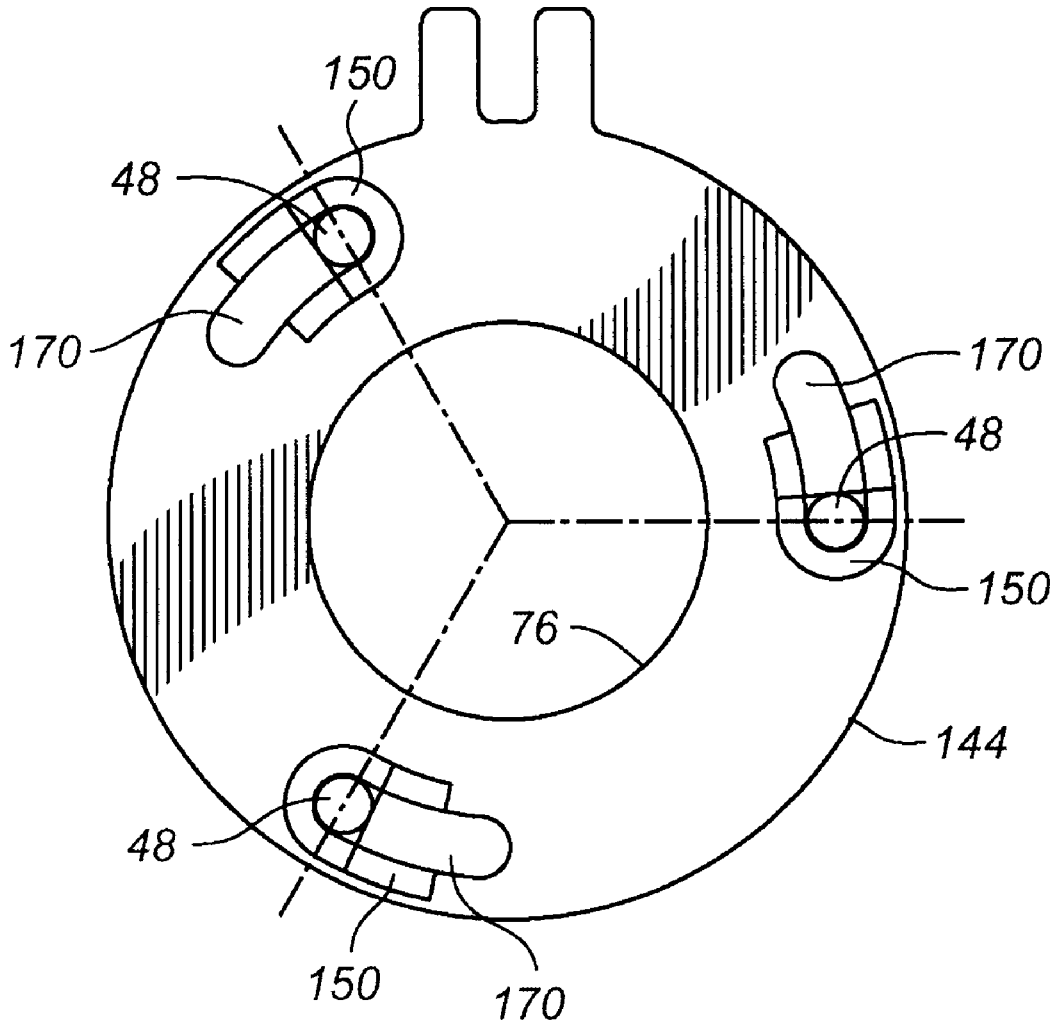
FIG. 7B is a cross-sectional view of the wedge plate from FIG. 7A.

Referring now to FIG. 7B, front wedge plate 144, which is identical to rear wedge plate 146, is shown in greater detail. Front wedge plate 144 surrounds barrel 16 and contains channels 170 through which collar rods 48 pass. Front wedges 150 are fixed to front wedge plate 144 and surround channels 170 in order to act against front wedge stops 148 which are fixed to collar rods 48.

Figure 7C:
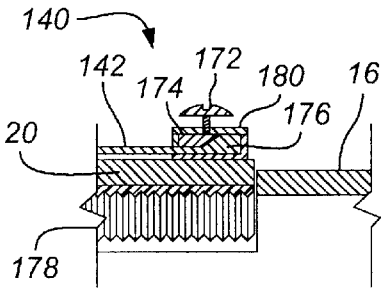
FIG. 7C is a sectional view friction plate engagement mechanism from FIG. 7A.

Referring now to FIG. 7C, a sectional view of front friction plate engagement mechanism 140, which is identical to rear friction plate engagement mechanism 154, is shown. As described above, the drawing of front friction plate engagement rod away from front friction plate engagement mechanism 140 causes adjustable friction plate 20 to be engaged. This is accomplished by rod end wedge 176 acting against fixed wedge 174 housed in housing 180. Rod end wedge 176 is forced down by fixed wedge 174 forcing adjustable friction surface 20 down into barrel 16 which allows inner surface 178 to act against the ball as it passes by to impart spin. Adjustment screw 172 mounted on housing 180 allows adjustment of the depth of adjustable friction surface 20 when it is engaged by changing the position of fixed wedge 174.

Figure 8:
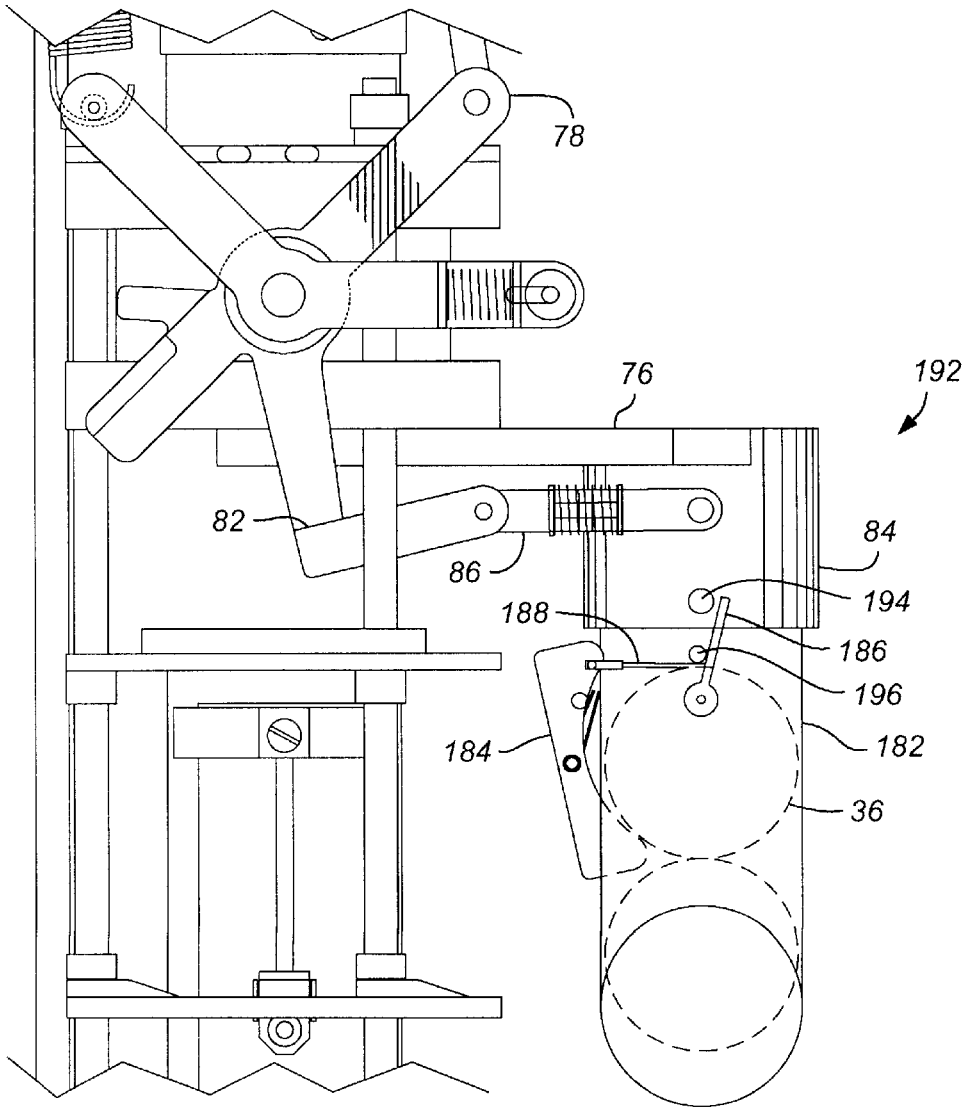
FIG. 8 is a top view of an automatic loading mechanism.

Referring now to FIG. 8, the operation of the automatic loader will be described. To further automate the operation of pitching machine 10, automatic loader 192 can be fitted to automatically feed balls into loading sleeve 84. Feeder tube 182 places balls in single file for loading into loading sleeve 84. Balls can be fed to feeder tube 182 via a hamper (not shown) or feeder tube 182 can be made large enough to accept multiple balls, which can then be reloaded manually. Rocker 184 separates ball 36 from the remaining balls in feeder tube 182. When loading sleeve is fully extended by loading sleeve arm 86, detent 194 moves ball release arm 186, which releases ball stop 196 allowing ball 36 to roll into loading sleeve 84 via gravity. Rocker reset arm 188 is moved by ball 36 as it rolls into loading sleeve 84 and moves rocker 184 to allow the next ball in feeder tube 182 to roll into position. Rocker 184 then returns to its original position separating the first two balls in the queue.

Pitching machine 10, particularly reservoir 12 and barrel 16, can be made of a variety of materials including ductile iron, fiberglass pipe such as that know by the brand name ZCORE, and aluminum. If barrel 16 is made of iron, aluminum or similar material, the preferred embodiment would include a reduced friction liner inside barrel 16 that can be replaced for wear. The liner can be formed from PVC or similar low friction material. Inner surface 178 of adjustable friction plate 20 is preferably formed from a material such as rubber or polyurethane, which will insure good contact with ball 36. Reservoir 12, in the preferred pneumatic embodiment, should have a working pressure of approximately 125 PSI, although the maximum pressure that should ever be necessary to propel a ball is about 65 PSI.

It is to be understood that although the invention has been described with particular reference to specific embodiments thereof, the form of the invention shown and described in detail is to be taken as the preferred embodiment of same, and that various changes and modifications may be resorted to without departing from the spirit and scope of the invention as defined by the appended claims.

I claim:

1. A pitching machine for propelling a ball from a barrel toward a target using expanding gases, comparing:

a propulsion mechanism connected to the barrel, the propulsion mechanism supplying expanding gases and including an opening to the barrel allowing the gases to expand behind the ball;

an engageable friction surface in the barrel, the engageable friction surface imparting spin to the ball when engaged; and said barrel which automatically adjusts opposite the direction of the spin of the ball in order to compensate for the spin of ball imparted by the engageable friction surface.

2. The pitching machine of claim 1 further comprising:

a reservoir holding compressed air and a quick release valve disposed between the reservoir and the barrel; and a pneumatic firing cylinder to open and a pneumatic cocking piston to rest the quick release valve.

3. The pitching machine of claim 1 further comprising an automatic loading mechanism operable to place a new ball into a loading sleeve, said loading sleeve being formed by a moveable section of the barrel.

4. The pitching machine of clam 1 further comprising a curve compensator to adjust for the curve of the ball resulting from the action of the engageable friction surface.

5. A pitching machine for propelling a ball a target using compressed air from a compressed air source, comprising:

a reservoir storing compressed air received from the compressed air source;

a barrel connected to the reservoir, the barrel holding the ball and directing the ball toward the target;

a valve located between the barrel and the reservoir, the valve holding the compressed air in the reservoir when valve is closed and controlling the release of the compressed air into the barrel when the valve is opened;

an engageable friction surface which is extendable into the barrel and imparts a spin to the ball when engaged; and a curve compensator formed by a main gear which turns in conjunction with said barrel and which adjust the aim of the pitching machine opposite the direction of the spin of the ball in order to compensate for the spin of the ball imparted by the engageable friction surface.

6. The pitching machine of claim 5 wherein the valve is operated by a pneumatic firing cylinder and a pneumatic cocking piston.

7. A pitching machine for propelling a ball toward a target using compressed air from a compressed air source, comprising:

a reservoir storing compressed air received from the compressed air source;

a barrel connected to the reservoir, the barrel holding the ball and directing the ball toward the target;

a valve located between the barrel and the reservoir, the valve holding the compressed air in the reservoir when the valve is closed and controlling the release of the compressed air into the barrel when the valve is opened, wherein the valve is operated by a pneumatic firing cylinder and a spring which are operable to open the valve, and a pneumatic cocking piston which is operable to reset the valve;

an engageable friction surface which is extendable into the barrel for imparting spin to the ball when engaged; and a curve compensator which automatically adjusts the aim of the pitching machine opposite the direction of the spin of the ball in order to compensate for the spin of the ball imparted by the engageable friction surface.

8. A pitching machine for propelling a ball toward a target using air compressed air from a compressed air source, comprising:

a reservoir storing compressed air received from the compressed air source;

a barrel connected to the reservoir, the barrel holding the ball and directing the ball toward the target;

a valve located between the barrel and the reservoir, the valve holding the compressed air in the reservoir when the valve is closed and controlling the release of the compressed air into the barrel when the valve is opened, wherein the valve is operated by a pneumatic firing cylinder and a spring which which are operable to to open the valve, and a pneumatic cocking piston which is operable to reset the valve;

a engageable friction surface which is extendable into the barrel for imparting spin to the ball when engaged; and a curve compensator formed by a main gear which turns in conjunction with said barrel and which adjusts the aim of the pitching machine opposite the direction of the spin of the ball in order to compensate for the spin of the ball imparted by the engageable friction surface.

9. The pitching machine of claim 8 further compressing an automatic loading mechanism, said automatic loading mechanism operable to place a new ball in a loading sleeve that forms part of the barrel, said loading sleeve being engaged and disengaged from the barrel by the cocking piston.

* * * * *